US007194382B2

(12) United States Patent
Lieuwen

(10) Patent No.: US 7,194,382 B2
(45) Date of Patent: Mar. 20, 2007

(54) SYSTEMS AND METHODS FOR DETECTION OF COMBUSTOR STABILITY MARGIN

(75) Inventor: Tim C. Lieuwen, Atlanta, GA (US)

(73) Assignee: Georgia Tech Research Corporation, Atlanta, GA (US)

( * ) Notice: Subject to any disclaimer, the term of this patent is extended or adjusted under 35 U.S.C. 154(b) by 42 days.

(21) Appl. No.: 11/051,885

(22) Filed: Feb. 4, 2005

(65) Prior Publication Data

US 2005/0247064 A1 Nov. 10, 2005

Related U.S. Application Data

(60) Provisional application No. 60/542,393, filed on Feb. 6, 2004.

(51) Int. Cl.
*G06F 11/30* (2006.01)
*G21C 17/00* (2006.01)

(52) U.S. Cl. ..... 702/182; 702/81

(58) Field of Classification Search ..... 702/81, 702/182; 60/779; 73/54.25
See application file for complete search history.

(56) References Cited

U.S. PATENT DOCUMENTS

| | | | | |
|---|---|---|---|---|
| 4,147,222 A | | 4/1979 | Patten et al. | 175/9 |
| 5,145,355 A | | 9/1992 | Poinsot et al. | 431/1 |
| 5,581,995 A | | 12/1996 | Lucenko et al. | 60/39.02 |
| 5,706,643 A | * | 1/1998 | Snyder et al. | 60/776 |
| 5,719,791 A | * | 2/1998 | Neumeier et al. | 700/274 |
| 5,752,379 A | | 5/1998 | Schafer et al. | 60/39.24 |
| 2002/0094267 A1 | | 7/2002 | Kim et al. | 415/118 |

FOREIGN PATENT DOCUMENTS

EP 0 774 573 B1 2/2002

OTHER PUBLICATIONS

Lieuwen, Timothy C., "Investigation of Combustion Instability Mechanisms in Premixed Gas Turbines," 1999, http://www.ae.gatech.edu/people/tlieuwen/publications/thesisfinal.pdf.*

Johnson, C.E.., et al., "Experimental Determination of the Stability Margin of a Combustor Using Exhaust Flow and Fuel Injection Rate Modulations", Proceedings of the Combustion Institute, vol. 28, 2000/pp. 757-763.

Hobson, D.E.., et al., "Combustion Instabilities in Industrial Gas Turbines—Measurements on Operating Plant and Thermoacoustic Modelling", The American Society of Mechanical Engineers, 99-GT-110.

* cited by examiner

*Primary Examiner*—Marc S. Hoff
*Assistant Examiner*—Janet L Suglo
(74) *Attorney, Agent, or Firm*—Sutherland Asbill & Brennan, LLP

(57) ABSTRACT

The present invention comprises systems and methods for determining stability margin of a combustor. One embodiment of the present invention includes the steps of providing a measuring device in communication with the combustor, wherein the measuring device generates signals indicative of combustor quantities; performing an autocorrelation calculation on the signals to determine the correlation time of the signals in the combustor; and determining the damping coefficient from the autocorrelation calculation, wherein the damping coefficient signifies a proximity of the combustor to instability. The damping coefficient may be estimated from the oscillatory envelope of the autocorrelation calculation data.

22 Claims, 12 Drawing Sheets

SYSTEMS AND METHODS FOR DETECTION OF COMBUSTOR STABILITY MARGIN

RELATED APPLICATION DATA

The present application claims benefit of U.S. Provisional Application No. 60/542,393, entitled "Method for Monitoring Combustion Dynamics Stability Margin," filed on Feb. 6, 2004, and incorporated herein by reference as if set forth in full.

TECHNICAL FIELD

This invention relates to combustors in gas turbine engines, afterburners, industrial processing devices, and other combustor devices, and more particularly, to systems and methods of monitoring the dynamic stability margin in such combustors.

BACKGROUND OF THE INVENTION

In order for turbine operators and/or control systems to optimize overall system performance across competing demands of emissions levels, power output, and engine life, maximum information about each component's health and performance is needed. One key issue that has emerged in combustion systems is that of combustion instabilities—that is, self-excited, combustion driven oscillations that generally occur at discrete frequencies associated with the combustor's natural acoustic modes. Minimizing the amplitude of these oscillations is essential for maximizing hot section part life—however, tradeoffs between dynamics amplitude, emissions, and power output are routinely encountered.

Currently, when turbines are being commissioned or simply going through day to day operation, the operator has no idea how the stability of the system is affected by changes to fuel splits/operating conditions unless, of course, the system actually becomes unstable.

Johnson et al. pursued an analysis technique for determine stability margin quantifications in a publication entitled "Experimental Determination of the Stability Margin of a Combustor Using Exhaust Flow and Fuel Injection Rate Modulations" presented at the *Proceedings of the Combustion Institute*, Vol. 28, 2000. Their technique required, however, a pulsing fuel injector and acoustic driver. Such external actuation is not a practical practice for operating combustors in day to day operations. As such, this technique may be useful in a lab setting but is not practical for a fielded system.

Hobson et al also attempted to infer combustor damping by monitoring the bandwidth of pressure or compressor casing vibration in a publication entitled "Combustion Instabilites in Industrial Gas Turbines—Measurements on Operating Plant and Thermoacoustic Modeling" as presented to the *International Gas Turbine & Aeroengine Congress & Exhibition* in June of 1999. However, the use of frequency domain techniques to determine damping are much more susceptible to noise and less robust than those described here.

Thus, there exists a need in the industry for a system and method to provide the combustor operator a quantitative description of how near a combustor is to its stability boundary, so that the user can determine whether small changes in fuel splits, operating or ambient conditions are likely to effect combustor dynamics.

SUMMARY OF THE INVENTION

The present invention comprises systems and methods for determining stability margin of a combustor. One embodiment of the present invention includes the steps of providing a measuring device in communication with the combustor, wherein the measuring device generates signals indicative of physical quantities in the combustor; performing an autocorrelation calculation on the signals to determine the correlation of the signals in the combustor; and determining the damping coefficient from the autocorrelation calculation, wherein the damping coefficient signifies a proximity of the combustor to instability. The damping coefficient may be estimated from the oscillatory envelope of the autocorrelation calculation data.

In one aspect of the present invention, the oscillatory envelope is calculated from a Hilbert Transform of the autocorrelation calculation data. In another aspect, the fit is a least squares fit.

The stability margin may be estimated from the time rate of change of the estimated damping coefficient. An increase of the damping coefficient over time may signify the combustor's approach to stable conditions and a decrease of the damping coefficient over time may signify the combustor's approach to unstable conditions.

In yet another aspect of the invention, the measuring device may measure a combustor quantity such as pressure, chemiluminescence, species concentration, temperature, ion current, rotor vibration, combustor can vibration, and casing vibration. In another aspect of the invention, a combustor controller may control combustor parameters to prevent instability in response to the increase of the damping coefficient over time. The combustion parameters may include engine fuel splits, power output, or other parameters that influence combustor stability. Another embodiment of the present invention includes a system for detecting stability margin in a combustor. The system includes a measuring device in communication with the combustor, wherein the measuring device generates signals indicative of a combustor quantity, and a stability margin detection unit that receives the signals and performs an autocorrelation technique on the pressure signal to determine the proximity of the combustor to instability. The measuring device measures a combustor quantity such as pressure, chemiluminescence, species concentration, temperature, ion current, rotor vibration, combustor can vibration, and casing vibration.

In yet another aspect, the autocorrelation technique includes a calculation of the autocorrelation data of the signal, a determination of an oscillatory envelope of the autocorrelation data, a determination of the damping coefficient from the oscillatory envelope of the autocorrelation data, and a determination of the stability margin based on the value of the damping coefficient.

In another aspect of the invention, the autocorrelation technique is implemented in real-time. The stability margin may be determined by the increase and decrease of the damping coefficient, respectively. In one aspect of the invention, the combustor controller controls combustor parameters in response to the results of the autocorrelation technique.

BRIEF DESCRIPTION OF DRAWINGS

Figure 1:
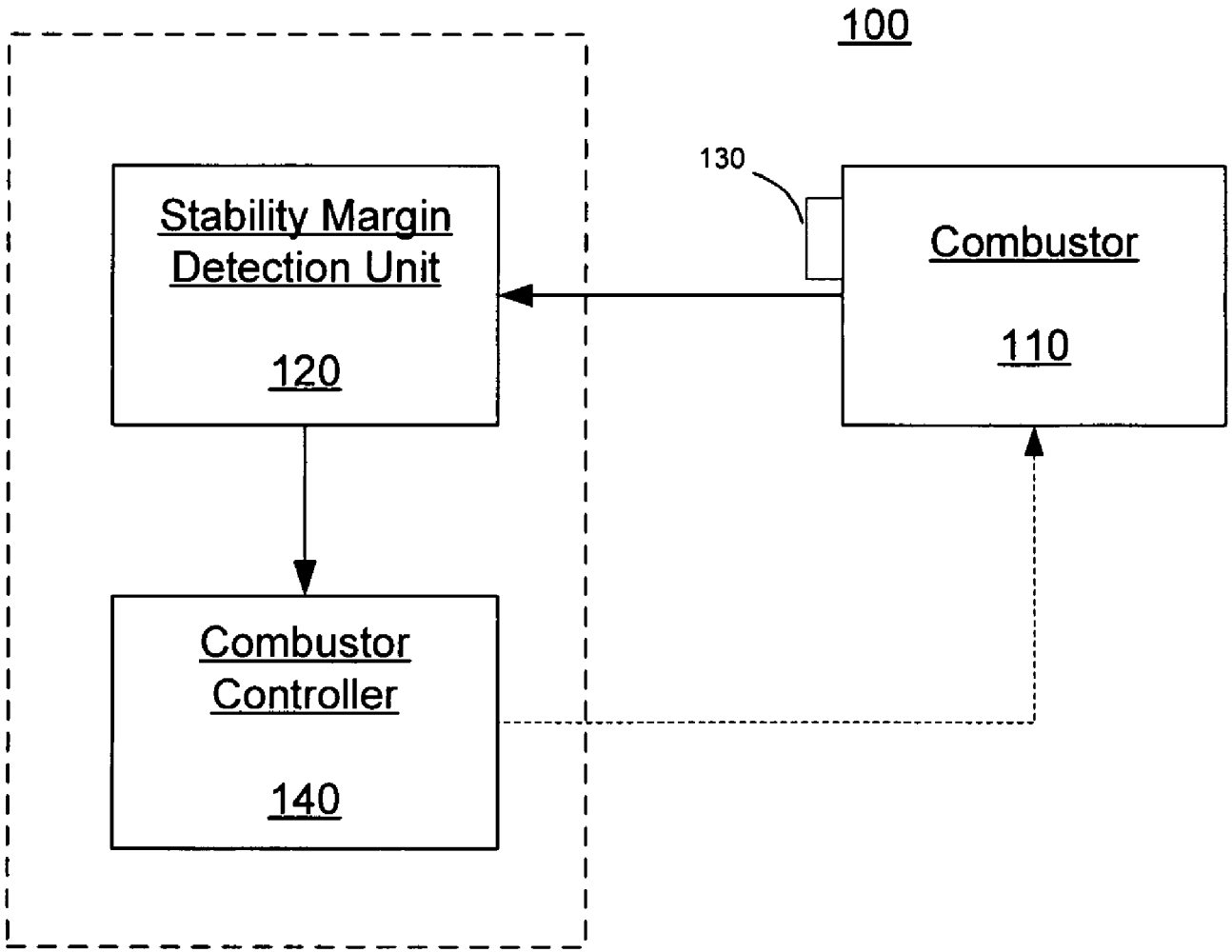

Having thus described the invention in general terms, reference will now be made to the accompanying drawings, which are not necessarily drawn to scale, and wherein:

FIG. 1 is a block diagram illustrating the basic components of a Combustor system.

Figure 2:
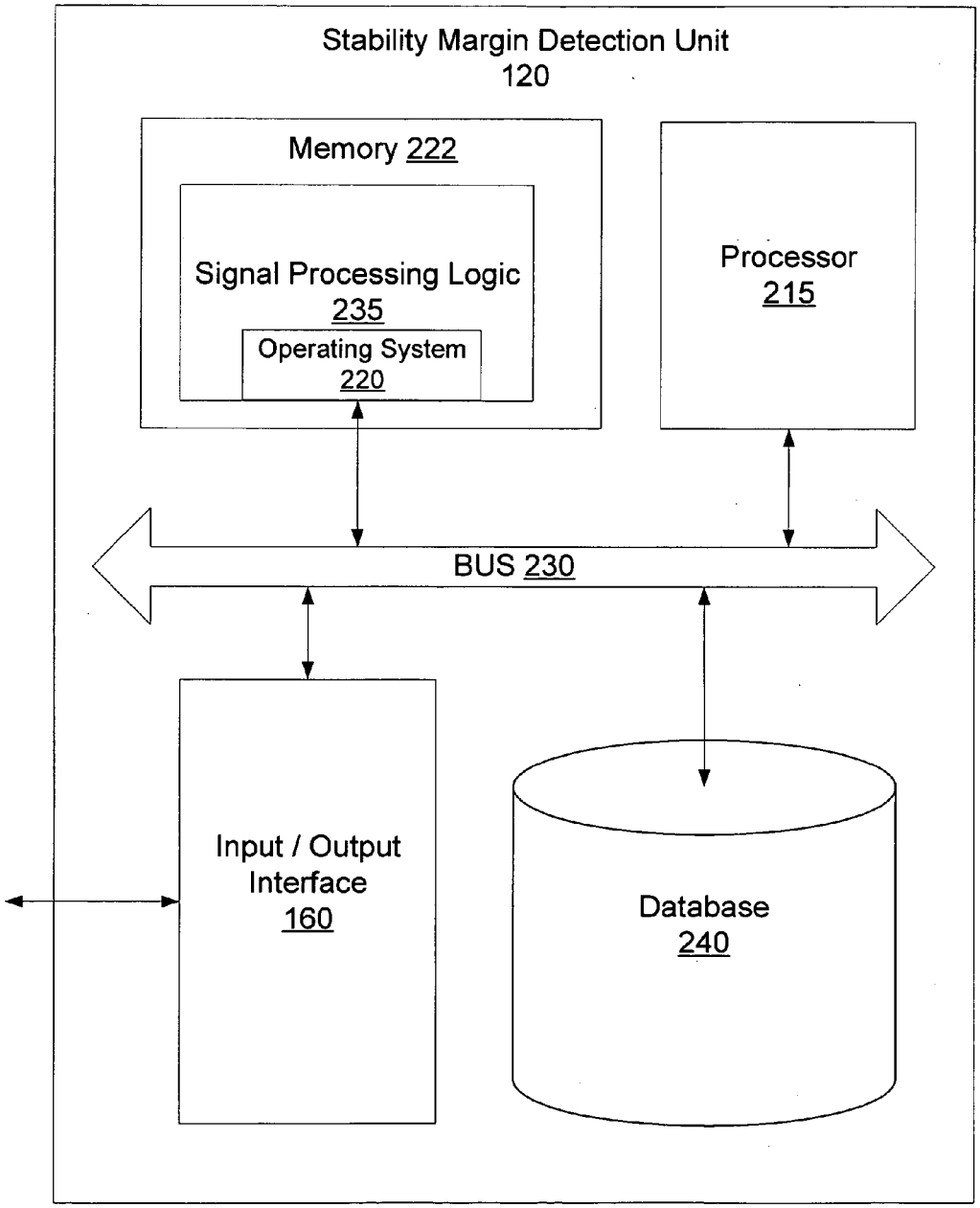

FIG. 2 is a block diagram illustrating the basic components of the stability margin detection unit.

Figure 3:
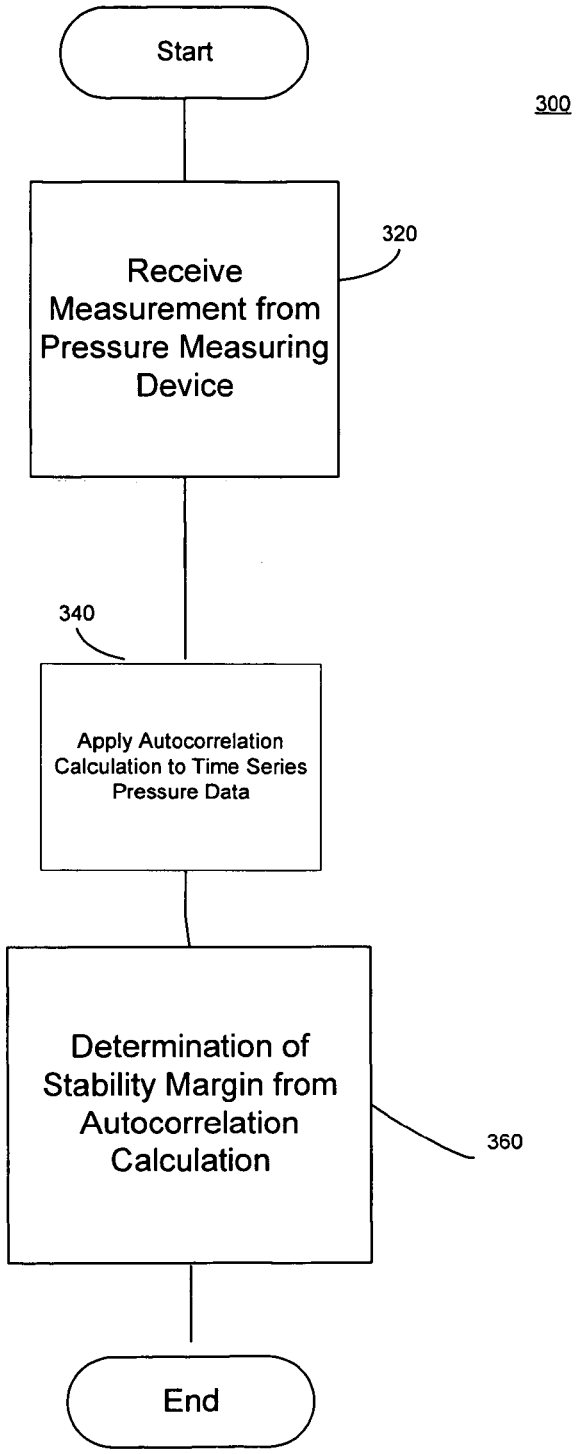

FIG. 3 is a block diagram of the method of determining the stability margin, according to one aspect of the present invention.

Figure 4:
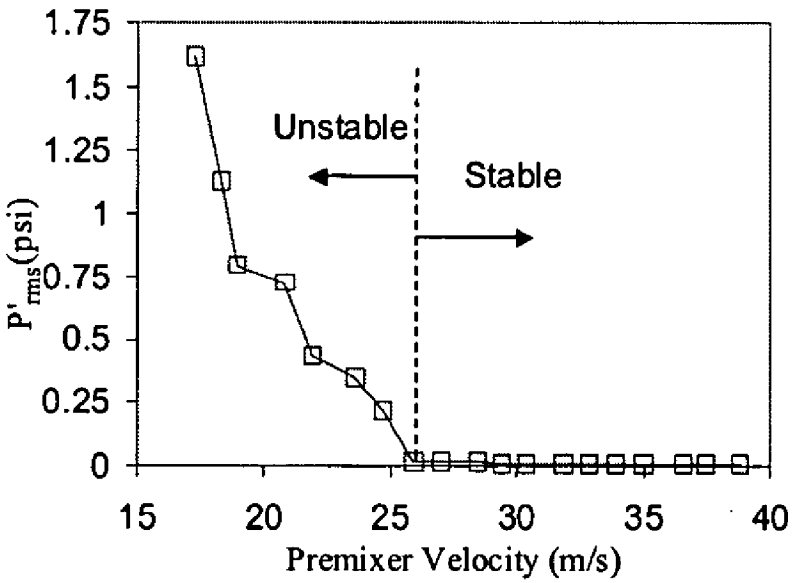

FIG. 4 is a plot of the pressure data of a combustor transitioning from stable to unstable conditions.

Figure 5:
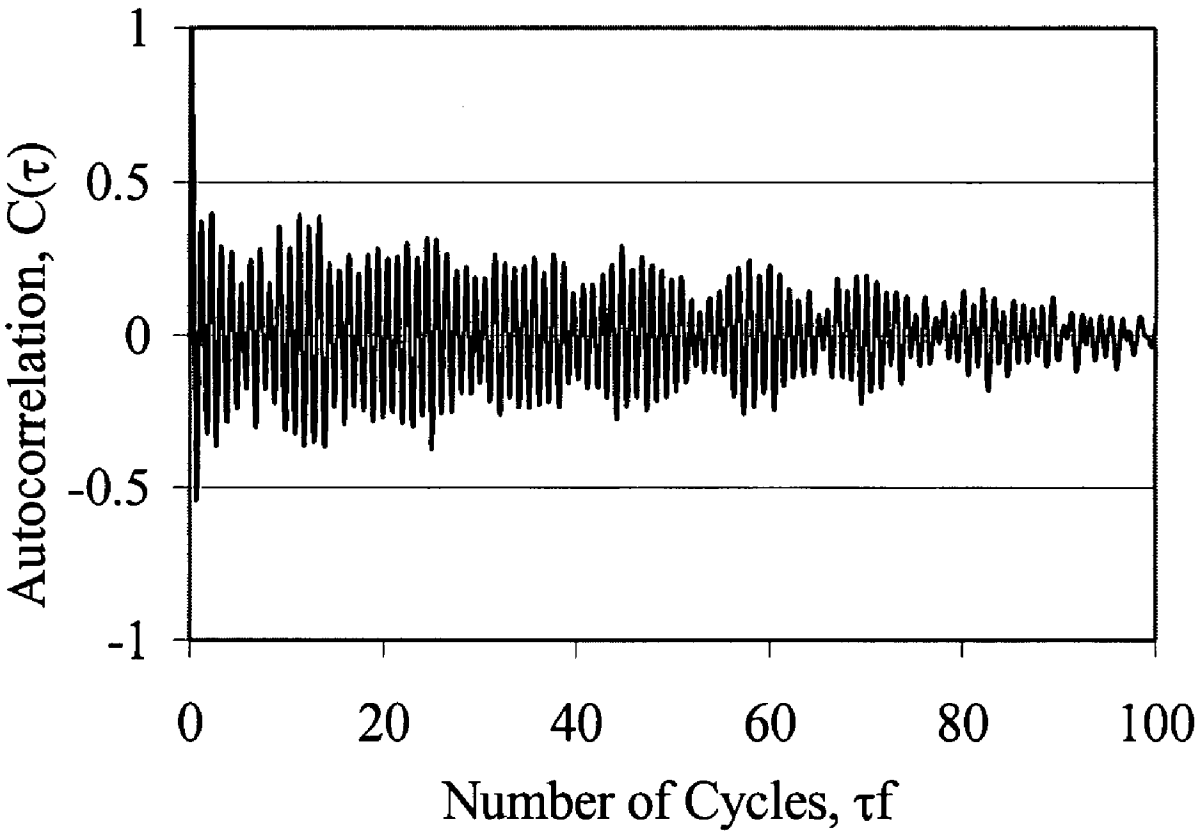

FIG. 5 is a plot of the autocorrelation data for a stable combustor.

Figure 6:
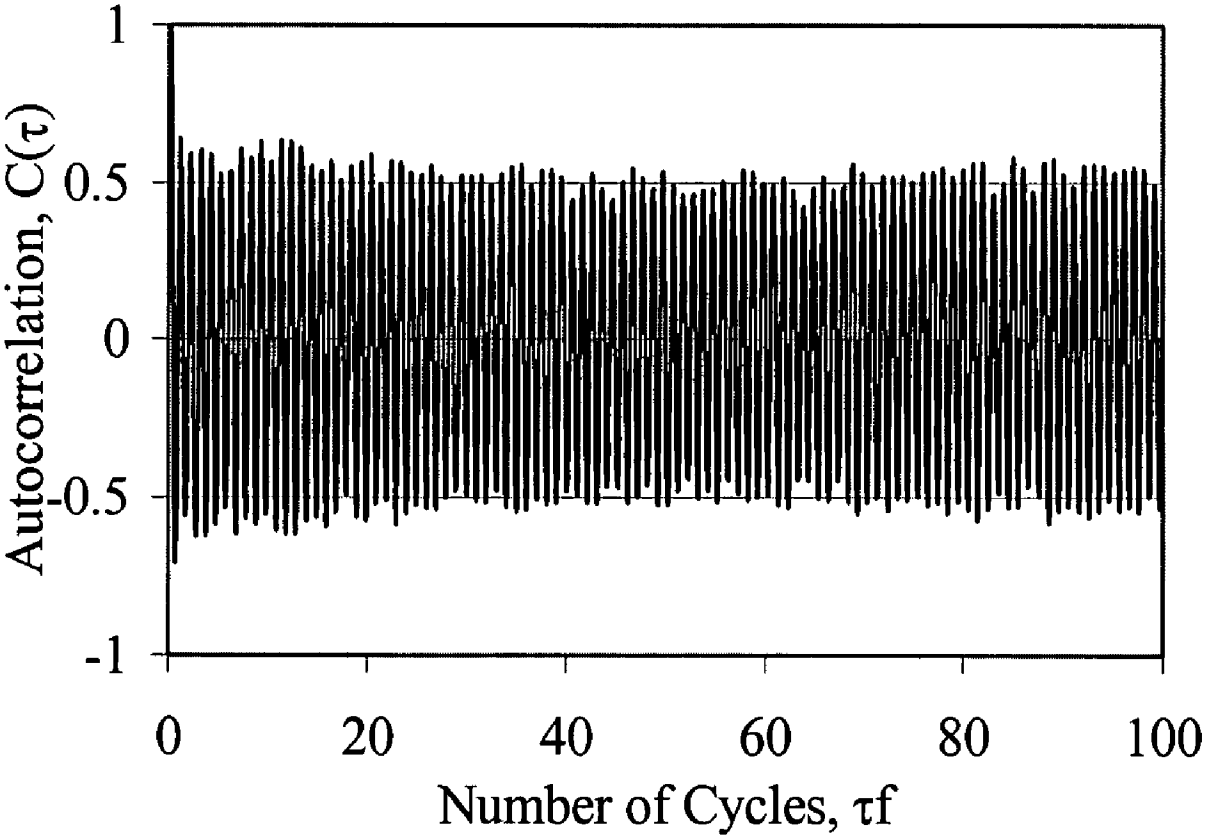

FIG. 6 is a plot of the autocorrelation data for an unstable combustor.

Figure 7:
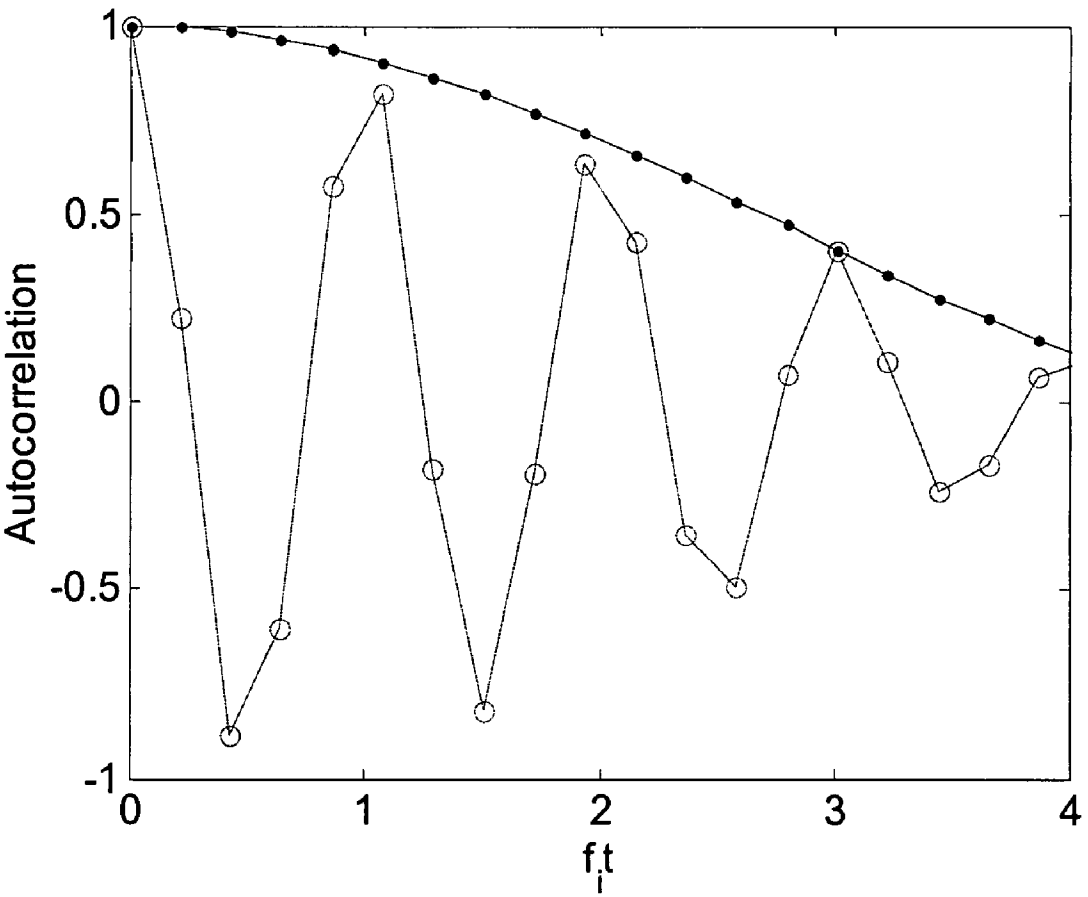

FIG. 7 is a plot of the oscillatory envelope of the autocorrelation data for a stable combustor.

Figure 8:
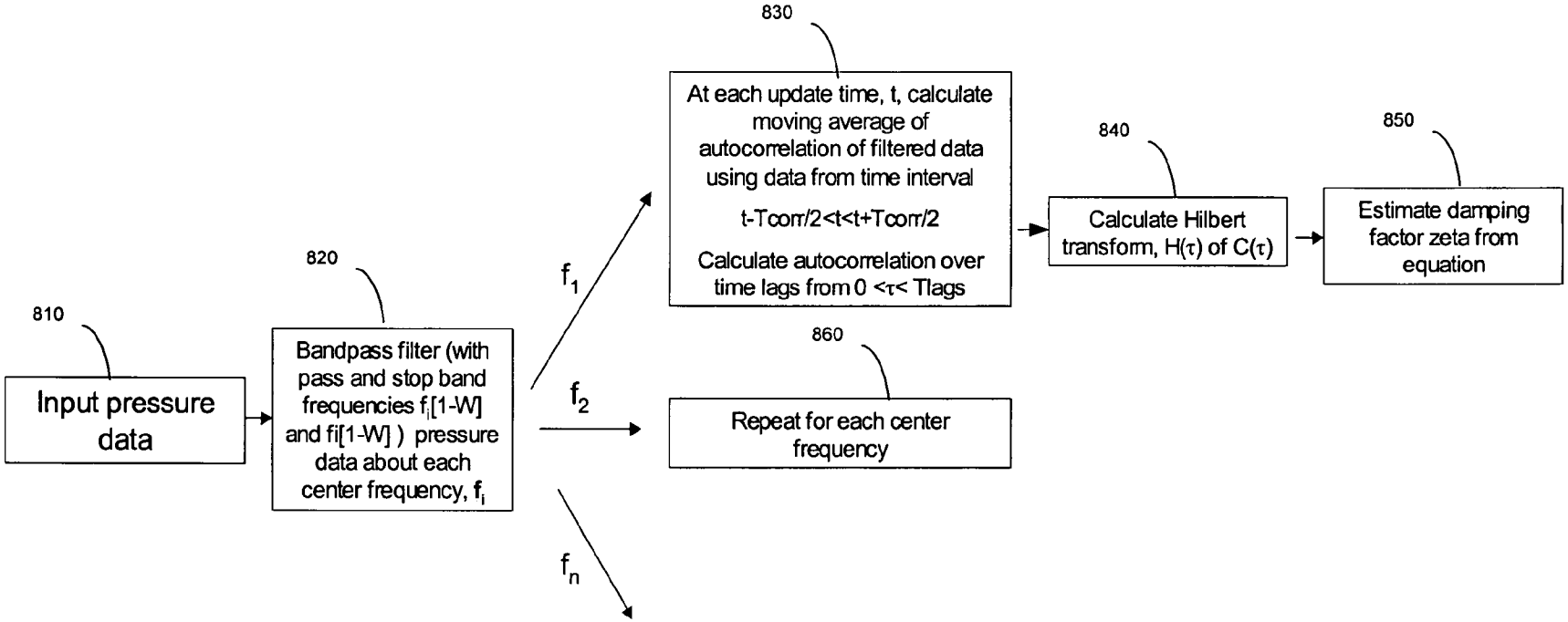

FIG. 8 is a block diagram of an exemplary embodiment of the method of determining the stability margin.

Figure 9:
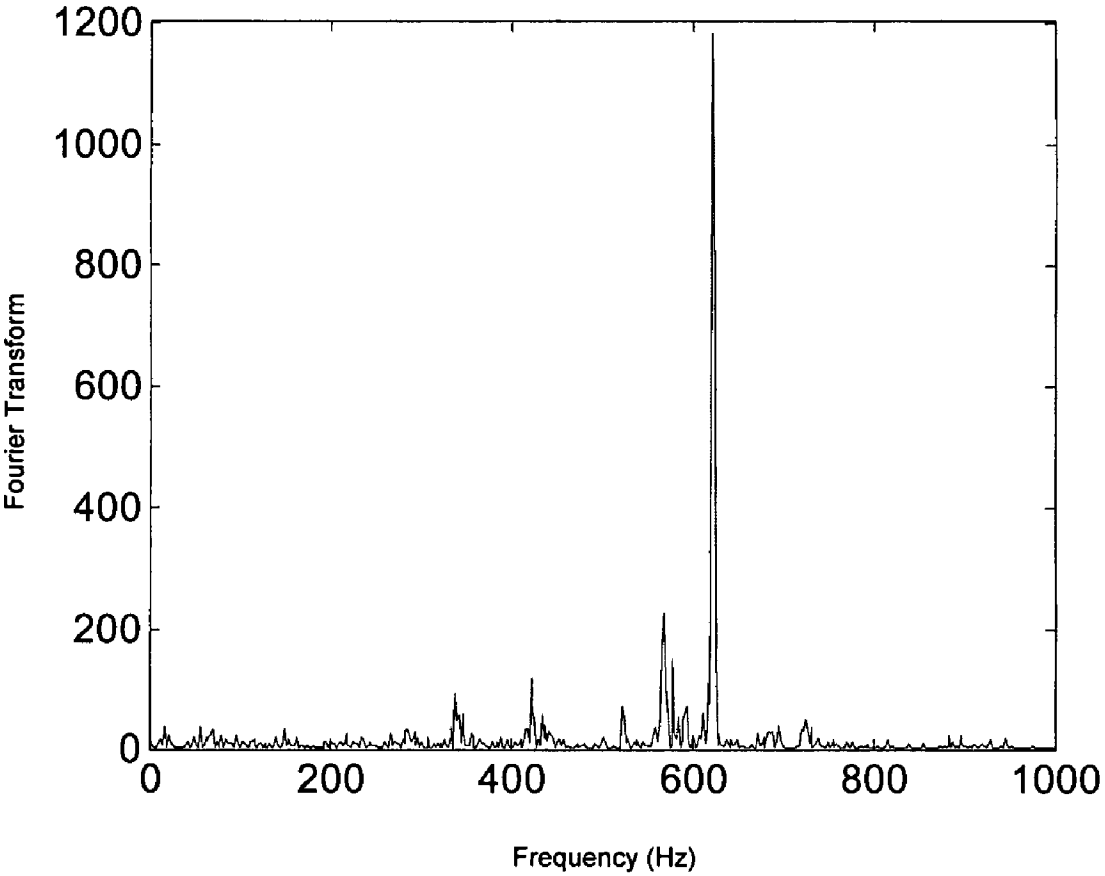

FIG. 9 is a plot of the Fourier Transform of the pressure data of a combustor used in an illustrative example.

Figure 10:
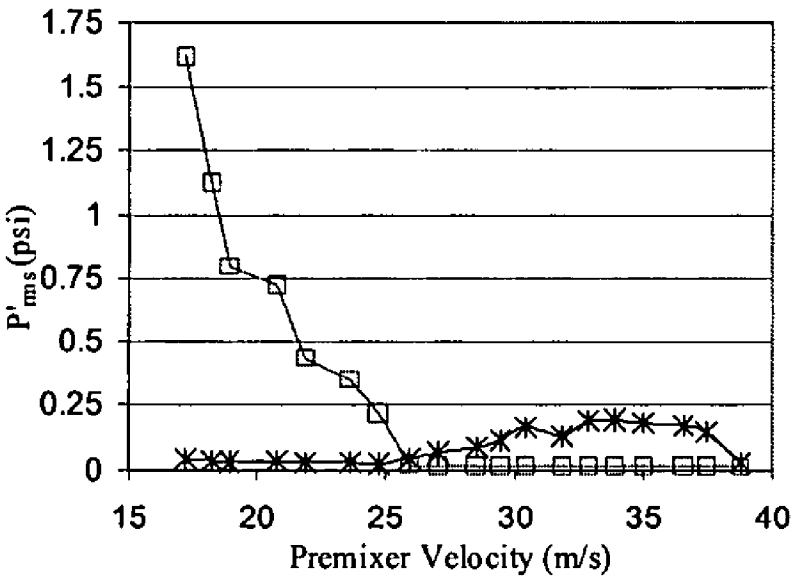

FIG. 10 is a plot of the pressure data of a combustor used in an illustrative example.

Figure 11:
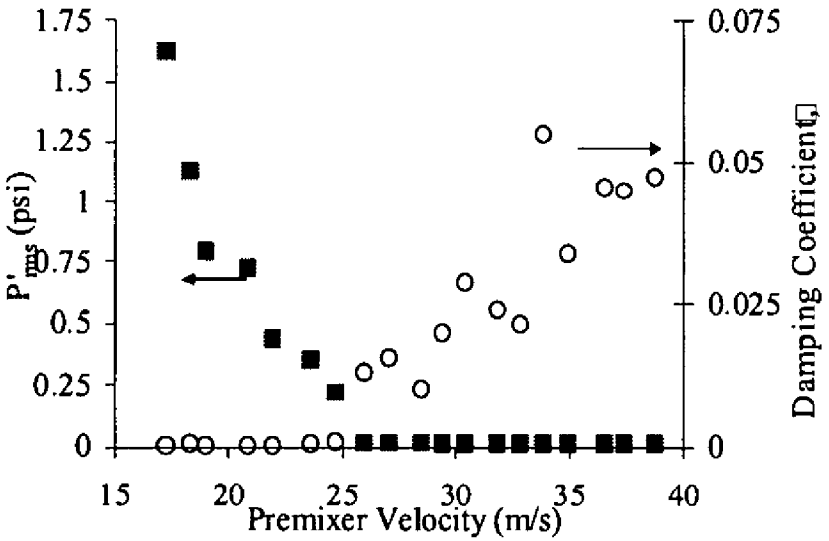

FIG. 11 is a plot of the pressure data and the damping coefficient of a combustor used in an illustrative example.

Figure 12:
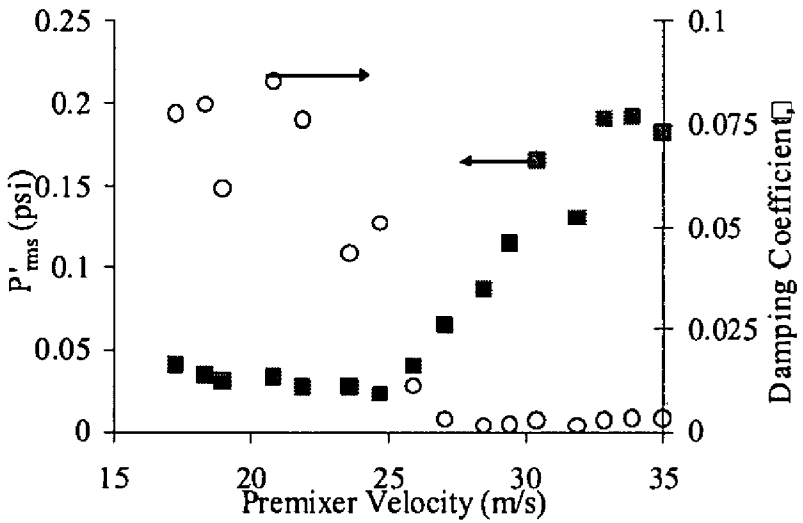

FIG. 12 is a plot of the pressure data and the damping coefficient of a combustor used in an illustrative example.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

The present invention is described below with reference to block diagrams and flowchart illustrations of systems, methods, apparatuses and computer program products according to an embodiment of the invention. It will be understood that each block of the block diagrams and flowchart illustrations, and combinations of blocks in the block diagrams and flowchart illustrations, respectively, can be implemented by computer program instructions. These computer program instructions may be loaded onto a general purpose computer, special purpose computer, or other programmable data processing apparatus to produce a machine, such that the instructions which execute on the computer or other programmable data processing apparatus create means for implementing the functions specified in the flowchart block or blocks.

These computer program instructions may also be stored in a computer-readable memory that can direct a computer or other programmable data processing apparatus to function in a particular manner, such that the instructions stored in the computer-readable memory produce an article of manufacture including instruction means that implement the function specified in the flowchart block or blocks. The computer program instructions may also be loaded onto a computer or other programmable data processing apparatus to cause a series of operational steps to be performed on the computer or other programmable apparatus to produce a computer implemented process such that the instructions that execute on the computer or other programmable apparatus provide steps for implementing the functions specified in the flowchart block or blocks.

Accordingly, blocks of the block diagrams and flowchart illustrations support combinations of means for performing the specified functions, combinations of steps for performing the specified functions and program instruction means for performing the specified functions. It will also be understood that each block of the block diagrams and flowchart illustrations, and combinations of blocks in the block diagrams and flowchart illustrations, can be implemented by special purpose hardware-based computer systems that perform the specified functions or steps, or combinations of special purpose hardware and computer instructions.

The present invention comprises systems and methods for accurately and robustly predicting the stability margin for combustors. The present invention is applicable to all types of combustors and is designed to operate over a diverse range of environmental condition, including varying temperatures, humidity, air compositions, and fuel compositions.

Exemplary embodiments of the present invention will hereinafter be described with reference to the figures, in which like numerals indicate like elements throughout the several drawings. FIG. 1 illustrates a combustor system 100 in accordance with the present invention. Advantageously, the present invention can be utilized with different types of combustors. Combustors applicable to this invention include but are not limited to combustors such as those found in industrial systems, land based or aeronautical gas turbine engines, afterburners, or ramjets. The design of the combustor and its disposition in an engine casing is well known to those skilled in the art and is in no way limited to the examples enumerated herein.

For purposes of illustrating the present invention, the combustion system 100 comprises a combustor 110 that is generally designed to receive compressed air from a compression section and fuel from fuel nozzles. The air and the fuel mix and burn to operate the engine. For purposes of the present invention, the combustor can be of any shape or configuration.

The combustion system may further include a stability margin detection unit 120, a measuring device 130, and a combustor controller 140. The stability margin detection unit 120 identifies the stability margin of the combustor at any given time. By identifying the stability margin one can prevent system failure or inefficient operation due to instability by making appropriate adjustments through the combustor controller 140.

The measuring device 130 is coupled to the combustor 110 and configured to detect one or several of many physical quantities, such as pressure, chemiluminescence, temperature, species concentration, ion current, rotor vibration, combustor can vibration, casing vibration, or any other physical quantity impacted by the heat release in the combustor or by combustor vibrations. In an exemplary embodiment, the measuring device 130 detects pressure. The measuring device 130 may be a pressure transducer or any other suitable device that accurately measures pressure and may be either analog or digital. In an exemplary embodiment, the measuring device 130 is a pressure transducer capable of measuring pressure oscillations up to roughly 5 KHz. The measuring device 130 may be mounted in the combustor, tangential to the combustor, or any other acceptable location that sufficiently measures a combustor quantity that is affected by heat release or combustor vibrations. The measuring device 130 also may be attached to a stand-off tube that may be mounted into the combustor 110 and extend out of the combustor 110.

The stability margin detection unit 120 is in communication with the measuring device 130. FIG. 2 shows a block diagram illustrating components comprising a stability margin detection unit 120 of the combustion system 100, according to one aspect of the present invention. The stability margin detection unit 120 is preferably configured with an operator interface for enabling the stability margin unit 120 to accept system setup information, input threshold settings and additional information applicable to detection of the stability margin. Alternatively, such information may be inputted by other suitable means, such as the combustion controller 140. The stability margin detection unit 120 is designed to receive data from the measuring device 130 and based thereon determine the stability margin of the combustor through an autocorrelation method as described herein.

According to an exemplary embodiment of the present invention, the stability margin detection unit 120 comprises software running on a microprocessor or other suitable computing device. The stability margin detection unit 120 may be embodied as a method, a data processing system, or a computer program product. Accordingly, the stability margin detection unit 120 may take the form of an entirely hardware embodiment, an entirely software embodiment or an embodiment combining software and hardware aspects. Furthermore, the stability margin detection unit 120 may take the form of a computer program product on a computer-readable storage medium having computer-readable program code means embodied in the storage medium. Any suitable computer-readable storage medium may be utilized including hard disks, CD-ROMs, optical storage devices, or magnetic storage devices.

As shown in FIG. 2, the stability margin detection unit 120 may comprise a processor 215, a memory 222, an operating system 220, an input/output interface 160 and a database 240, all in communication via a local interface bus 230. Briefly, the processor 215 executes the operating system 220, which controls the execution of other program code such as that comprising the signal processing logic 235 for implementing the functionality described herein. The local interface bus 230 may be, for example but not limited to, one or more buses or other wired or wireless connections. The local interface bus 230 may have additional elements, which are omitted for simplicity, such as controllers, buffers (caches), drivers, repeaters, and receivers, to enable communications. Furthermore, the local interface bus 230 may include address, control, and/or data connections to enable appropriate communications among the aforementioned components.

The processor 215 is a hardware device for executing software, particularly that stored on memory 222. The processor 215 may be any custom-made or commercially-available processor, a central processing unit (CPU), an auxiliary processor among several processors associated with the system 100, a semiconductor-based microprocessor (e.g., in the form of a microchip or chip set), a macroprocessor, or generally any device for executing software instructions.

The memory 222 may comprise an operating system 220 and the signal processing logic 235. The architecture, operation, and/or functionality of signal processing logic 235 will be described in detail below. The memory 222 may include any one or combination of volatile memory elements (e.g., random access memory (RAM), such as DRAM, SRAM, SDRAM, etc.) and non-volatile memory elements (e.g., ROM, hard drive, tape, CD-ROM, etc.). The memory 222 may incorporate electronic, magnetic, optical and/or other types of storage media. Furthermore, memory 222 may have a distributed architecture, in which various components are situated remote from one another, but can be accessed by processor 215.

The software in memory 222 may include one or more separate programs, each of which comprising executable instructions for implementing logical functions. In the example of FIG. 2, a software in memory 222 includes the signal processing logic 235 according to the present invention. The memory 222 may further comprise a suitable operating system 220 that controls the execution of other computer programs, such as the signal processing logic 235, and provides scheduling, in-output control file and data management, memory management, and communication control and related services.

The input/output interfaces 160 may be any device or devices configured to facilitate communication with the pressure measuring device 130. The communications can be with a communication network, such as a public or private packet-switched or other data network including the Internet, a circuit switched network, such as the public switch telephone network, a wireless network, an optical network, or any other desired communication infrastructure. Alternatively, the input/output interfaces may also include any one of the following or other devices for facilitating communication with local interface bus 230: a user interface device such as a keyboard or mouse, a display device such as a computer monitor, a serial port, a parallel port, a printer, speakers, a microphone, etc. During operation of the stability margin detection unit 120, a user may interact with the signal processing logic 235 via such user interface and display devices.

The signal processing logic 235 may be a source program, executable program (e.g., object code), script, or any other entity comprising a set of instructions to be performed. When implemented as a source program, then the program needs to be translated via a compiler, assembler, interpreter, or like, which may or not be included within the memory 222, so as to operate properly in connection with the operating system 220. Furthermore, the signal processing logic 235 may be written as an object oriented program language, which has classes of data and methods, or a procedure program language, which has routines, sub-routines, and/or functions, for example but not limited to, C++, Pascal, Basic, Fortran, Cobol, Perl, Java, and Ada.

It will be appreciated by one of ordinary skill in the art that one or more of the stability margin detection unit 120 components may be located geographically remotely from other stability margin detection unit 120 components. Furthermore, one or more of the components may be combined, and additional components performing functions described herein may be included in the stability margin detection unit 120. In addition, one or more, if not all, of the components of the stability margin detection unit 120 may be incorporated into the combustor controller 140.

The stability margin detection unit 120 is configured to receive through the input/output interface 160 data captured by the measuring device 130. As discussed in regards to the FIG. 3, the signal processing logic 235 utilizes an autocorrelation method to analyze pressure data for the detection of a stability margin. One of ordinary skill in the art will appreciate that the signal processing logic 235 is not limited to pressure data but may be any combustor quantity. The signal processing logic 235 may include hard-coded threshold values for stability margin detection or may use input threshold values inputted into the memory 222 through the input/output interface 160. The detection of a stability margin may result in a signal being communicated to the combustion controller 140 that indicates that the combustor is near unstable conditions.

The combustion controller 140 may control the operation of the combustor 110 and is in communication with the stability margin detection unit 120. Such controllers controlling the operation of a combustor are well known, and therefore are not described in detail as a part of this disclosure. Upon receiving a signal indicating the value of the stability margin of the combustor by the signal processing logic 235, the combustion controller 140 will make appropriate adjustments to the operating parameters of the combustor 110 to ensure stable operation of the combustor. Combustor parameters adjusted may include but are not limited to the amount of fuel from the fuel inlet nozzles, the amount of compressed air allowed in the combustion chamber, and the desired engine power output.

FIG. 3 is a flow chart illustrating the architecture, functionality and/or operation of the signal processing logic 235 in a accordance with an exemplary embodiment of the present invention. In the exemplary embodiment, pressure data may be used in the method of FIG. 3. One of ordinary skill in the art will appreciate that the method of FIG. 3 is not limited to pressure data but may be any combustor quantity including chemiluminescence, species concentration, temperature, ion current, rotor vibration, combustor can vibration, casing vibration, or any other physical quantity impacted by the heat release in the combustor or by combustor vibrations. For illustrative purposes only, the remainder of the detailed description will use pressure data as an example combustor quantity; however, any combustor quantity may be used in the present invention.

As illustrated in FIG. 3, the method 300 begins by receiving pressure data from the pressure measuring device, as indicated in step 320. The data may be received from either a digital or analog pressure measuring device 130. If the pressure measuring device 130 is analog, one of ordinary skill in the art would appreciate the step of sampling the data and performing known signal processing techniques to ensure an accurate and quality digital representation of the analog signal, such as implementing anti-aliasing filters.

The received pressure data may be analyzed using an autocorrelation technique, as indicated in step 340. The autocorrelation technique calculates autocorrelation data that represent the correlation of the pressure data within the combustor. After calculating the autcorrelation data in step 340, the stability margin is determined at step 360. As described in more detail to follow, the stability margin may indicate the combustor's proximity to unstable operating conditions. The method for determining stability margin may end after the stability margin detection step 360, or alternatively, the method may continuously operate on the pressure data as it is received from the combustor.

The autocorrelation technique provides a more robust method of determining the stability margin than viewing the pressure data alone. As illustrated in FIG. 4, the pressure data may be used to determine instability of the combustor. It is understood by one of ordinary skill in the art that increased dynamic pressure amplitudes in the combustor typically indicate unstable operating conditions. It also is understood by one of ordinary skill in the art that decreases in dynamic pressure amplitude in the combustor typically indicate stable operating conditions. FIG. 4 represents a plot of the normalized pressure within the combustor versus the mean inlet velocity. The data represented in FIG. 4 was generated from a combustor at Georgia Institute of Technology, though the teaching of the results of FIG. 4 are not limited to the exemplary combustor but are applicable to all combustors. As shown in FIG. 4, a low normalized pressure level signifies a stable operating conditions of the combustor. As the normalized pressure increases, the combustor enters unstable operating conditions. For example, at approximately 25 m/s in the exemplary combustor of FIG. 4, the normalized pressure begins to increase from zero, and the combustor becomes unstable.

It is evident from FIG. 4 that monitoring the pressure amplitude in stable conditions does not indicate the proximity of the combustor to instability, but only that the system is either stable or unstable. For instance, at mean inlet velocity of 18 m/s the normalized pressure is zero, and at 22 m/s, the normalize pressure remains zero. It cannot be determined from the pressure data alone whether the combustor approaches instability as the mean inlet velocity increases from 18 m/s to 22 m/s. Thus, the proximity of the combustor to instability cannot be measured by viewing the pressure data alone.

Conversely, the proximity of the combustor to instability may be identified based on the rate at which acoustic oscillations are damped in a stable combustor. In normal operation, inherent combustor noise is continuously exciting pressure oscillations in the combustor system. Under stable conditions, these pressure oscillations and background noises in the combustor are naturally damped. In contrast, under unstable conditions, the pressure oscillations are self-excited resulting in undamped conditions.

The autocorrelation technique applied at step 340 may be used to determine stability margin based on a time series of pressure data from within the combustor. The autocorrelation technique can determine the correlation of the pressure in combustors operating in normal operating conditions. The length of time over which the pressure data is correlated is related to the level of system damping. Pressure signals correlated over a long period of time signify a system that is less damped than a system with pressure correlated over a short time interval. As appreciated by one of ordinary skill in the art, as the damping of a system decreases, the system tends towards instability.

The autocorrelation technique of step 340 operates on the pressure naturally occurring in the combustor. That is, no external pressure excitations are required to determine the damping characteristics of the system. Therefore, the autocorrelation technique can be used on a combustor in normal operating conditions to determine the stability margin.

The autocorrelation technique operates solely in the time domain as opposed to the frequency domain. Operation in the time domain provides a more robust solution than operation in the frequency domain. This is due to the fact that the autocorrelation is more noise insensitive than the Fourier transform. (e.g., see A. Papoulis, "The Fourier Integral and its Applications", 1962). In addition, subtle variations in the rate of decay of the autocorrelation are much more evident in the autocorrelation than the Fourier transform.

Inferring the damping coefficient from autocorrelation data requires a mathematical model. A representative model is shown below. However, this invention is not limited to the regimes of validity of this model. The following mathematical operations may be used to determine the autocorrelation of the pressure data in the combustor and ultimately estimate the damping coefficient. Pressure oscillations in combustion chambers can be described as a superposition of nonlinearly interacting oscillators of the form in equation (1) below:

$$p'(t) = \xi(t) + \sum_{i=1}^{N} \eta_i(t) \tag{1}$$

Where the sum of $\eta(t)$ is the acoustic mode, N is the number of acoustic modes, $\xi(t)$ is random noise, and $p'(t)$ is the measured pressure.

The dynamics of the acoustic modes can be described as follows in equation (2):

$$\frac{d^2\eta_i(t)}{dt^2} + 2\tilde{\zeta}_i\omega_i\frac{d\eta_i(t)}{dt} + \tilde{\omega}_i^2\eta_i(t) = f_i\left(\eta_j(t), \frac{d\eta_j(t)}{dt}, \ldots\right) + E_i(t) \tag{2}$$

where, $\omega$ is the frequency of the acoustical oscillations at the particular acoustic mode, the function $f(\eta(t), d\eta/dt)$ describes the linear and nonlinear forcing terms, $\zeta$ is the damping coefficient, and E(t) describes external forcing of the oscillator by noise. One of ordinary skill in the art will appreciate that this model is provided for exemplary purposes and that this invention is not limited to the regimes of validity of this model.

Under stable conditions, the oscillations are generally of sufficiently low magnitude such that nonlinear terms are negligible reducing the dynamics of the acoustic modes to equation (3) below:

$$\frac{d^2\eta_i(t)}{dt^2} + 2\varsigma_i\omega_i\frac{d\eta_i(t)}{dt} + \omega_i^2\eta_i(t) = E_i(t) \tag{3}$$

The acoustic mode equation above is not directly solved without knowing the temporal evolution of E(t). Thus, an autocorrelation technique may be used to solve the above equation. In an exemplary embodiment, the autocorrelation equation for the acoustic modes may be defined as follows in equation (4):

$$C_i(\tau) = \frac{\int_0^T \eta_i(t)\eta_i(t+\tau)\,dt}{\int_0^T \eta_i^2(t)\,dt} \tag{4}$$

Assuming the background noise is white noise, the autocorrelation equation in the exemplary embodiment can be reduced to equation (5) below:

$$C_i(\tau) = e^{-\omega_i\zeta_i\tau}\left(\cos(\omega_i\tau\sqrt{1-\zeta_i^2}) + \zeta/\sqrt{1-\zeta_i^2}\,\sin(\omega_i\tau\sqrt{1-\zeta_i^2})\right) \tag{5}$$

The damping coefficient $\zeta$ is relatively small in typical combustors. Therefore, the second term of the above autocorrelation equation is neglible compared to the first term. As such, the autocorrelation oscillates at a frequency roughly equal to co and has an envelope that decays as $\exp(-\omega_i\zeta_i t)$. Therefore, the damping coefficient can be directly related to the decay in the envelope of autocorrelation for various acoustical modes.

Applying the autocorrelation equation to pressure data in stable conditions, the oscillations correlation time is very short. As the combustor system approaches instability however, the correlation time increases. Monitoring the correlation time of the oscillations, therefore, provides a means for identifying the proximity of the combustor system to instability.

FIGS. 5 and 6 provide non-limiting examples of the autocorrelation technique in stable and unstable operating systems in accordance with the present invention. As shown in FIG. 5, the autocorrelation value has an amplitude of 1 at cycle zero. Over the time series, the autocorrelation value decreases, thereby, indicating that oscillations over these time intervals are increasingly uncorrelated. Uncorrelated data represents a stable combustor system.

Conversely, as shown in FIG. 6, the autocorrelation value has an amplitude of approximately 1 at cycle zero. As can be viewed from the time series data, the autocorrelation value does not decrease over time indicating correlated data and, therefore, unstable combustor conditions.

The value of the autocorrelation data is not limited in magnitude herein. One of ordinary skill in the art would appreciate that any autocorrelation value is applicable to the methods of this invention.

From the autocorrelation data, the stability margin can be determined from an envelope of the oscillatory autocorrelation data. In one exemplary embodiment, this can be done by obtaining these points directly from the autocorrelation. In another exemplary embodiment, the envelope of the oscillatory autocorrelation data may be calculated using the Hilbert Transform and may be defined as follows in equation (6):

$$H_i(\tau) = \frac{1}{\pi}\int_{-\infty}^{\infty} \frac{C_i(t)}{\tau - t}\,dt \tag{6}$$

An example of the oscillatory envelope for a damped, stable combustor calculated by the Hilbert transform is shown in FIG. 7. The oscillatory envelope describes the rate of decay of the oscillations in the combustor. In an exemplary embodiment, the damping coefficient can be determined from a fit of the oscillatory envelope describing the decay rate of the oscillations from the fit of the equation $\exp(-\omega_i\zeta_i t)$. In one aspect of this embodiment, the damping coefficient was estimated by taking the natural logarithm of $H_i(t)$ and performing a least squares fit of $\exp(-\omega_i\zeta_i t)$. Equation (7) below is an example of how the damping coefficient may be calculated from the oscillatory envelope.

$$\zeta(t) = -\frac{1}{2\pi}\frac{\sum_{j=1}^{Nlags} \tau_j \ln H(\tau_j)}{\sum_{k=1}^{Nlags} (\tau_k)^2} \tag{7}$$

Where, $\tau$ is the time lag between zero and the autocorrelation time lag interval over which the damping coefficient is determined. Nlag represents the number of time lag data points.

However, this invention is not limited to fits of the form $\exp(-\omega_i\zeta_i t)$ or equation (7). For example, more complex fits of the autocorrelation envelope are also contemplated herein such as those which include effects of heat release dynamics, non-whiteness of background noise, or parametric noise sources. One of ordinary skill in the art will further appreciate that any other method for calculating the oscillatory envelope is contemplated herein such as manually locating the peaks of the autocorrelation or other methods. The Hilbert transform approach described here is only provided as an exemplary embodiment. One of ordinary skill in the art will appreciate that any method of predicting the rate of decay and the damping coefficient of the oscillatory envelope also is contemplated herein including other forms of curve fitting besides the least squares regression described above.

The stability margin may be calculated from the value of the damping coefficient as it changes over time. For example, changes in environmental conditions that impact the combustor stability margin could be monitored by the technique shown here. The stability margin may be used either in a closed loop feedback control system, or by a manual operator to suitably adjust the engine fuel splits, power output, or any other parameter impacting combustor stability.

FIG. 8 illustrates an exemplary method of estimating the damping coefficient in the combustor using pressure data. Step 810 begins by reading the pressure data in the combustor using the measuring device 130. The pressure data may be filtered at step 820. In the exemplary embodiment, a bandpass filter (with pass and stop band frequencies $f_i[1-W]$ and fi[1−W]) is used on the pressure data about each center frequency, $f_i$. W represents the width of the bandpass filter and represents the center frequency of each mode to be monitored. One of ordinary skill in the art will appreciate that any appropriate filter may be used. At step 830, a moving average of the autocorrelation data from the filtered data may then be calculated at each update time, t. The time interval used in this step may include $t-Tcorr/2<t<t+Tcorr/2$, where Tcorr is the moving window width over which autocorrelation of data is estimated. The autocorrelation may then be determined over time lags $0<t<Tlag$, wherein the time lag, Tlag, represents a autocorrelation time lag interval over which estimated damping coefficient is determined. The Hilbert transform may then be calculated from the oscillatory envelope at step 840. From the oscillatory envelope, the damping coefficient may be determined at step 850. In an exemplary embodiment, equation (7) above may be used to calculate the damping coefficient. As illustrated in step 860, steps 810 through 850 may be repeated for all modes or center frequencies of the combustor. One of ordinary skill in the art will appreciate that the method of FIG. 8 is for illustrative purposes and does not limit the invention to that embodiment.

The present invention can be further understood with the following non-limiting example relating to the estimation of the damping coefficient.

The invention was tested with a gas turbine combustor simulator. A set of 18 test runs were chosen where a premixer velocity was varied between 17–39 m/s at a fixed flow rate and equivalence ratio ($\phi$=0.89). These particular test runs were chosen because of the large variations in amplitude that occurred in two of the combustor modes and some variations in several others as well; as such, they serve as a useful demonstrator of the capabilities of the proposed method to simultaneously track the stability characteristics of several modes. A typical Fourier transform illustrating these modes is shown in FIG. 9. The two dominant instabilities occur at 430 and 630 Hz. The dependence of pressure amplitudes upon premixer velocity is shown in FIG. 10, wherein the (□) plot represents pressure amplitudes at 430 Hz and (*) plot represents pressure amplitudes at 630 Hz.

The FIGS. 11 and 12 plot the simultaneous dependence of the pressure amplitude and damping coefficient of each of the instability modes. The damping coefficients were determined using the methods of this invention, and fitting a least squares fit over four cycles of data.

FIG. 11 plots the pressure amplitude and damping coefficient for the 430 Hz mode, wherein the (□) plot is the pressure amplitude and the (o) plot is the calculated damping coefficient. Starting at the premixer velocity of 40 m/s for example, the estimated damping coefficient monotonically decreases with a decrease in premixer velocity, even while the actual pressure amplitude stays essentially zero. The decreasing damping coefficient suggests that the combustor stability margin is decreasing, a fact that is evident from an overall view that the pressure data begins increasing.

A similar result is shown in FIG. 12 for the 630 Hz mode. The damping coefficient monotonically decreases as the premixer velocity increases from 15–25 m/s indicating a decreasing stability margin as the premixer velocity increases. In this case however, the corresponding pressure amplitude actually decreases slightly across this velocity range. If the pressure amplitude alone was analyzed to determine stability, one would wrongly conclude that the stability margin were increasing—that is, becoming more stable.

As is clear from analyzing the 430 Hz and the 630 Hz modes, the damping coefficient can be used to predict the stability margin of the combustor to determine the proximity of the combustor to instability.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in generic and descriptive sense only and not for purposes of limitation.

That which is claimed:

1. A method for detecting the stability margin in a combustor, comprising:

providing a measuring device in communication with the combustor, wherein the measuring device generates signals indicative of combustor quantities in the combustor;

performing an autocorrelation calculation on the signals to determine the correlation of the signals in the combustor; and calculating the damping coefficient from the autocorrelation calculation;

determining the combustor's proximity to instability based on the damping coefficient; and controlling the stability of the combustor based on the determination of the combustor's proximity to instability.

2. The method of claim 1, wherein calculating the damping coefficient comprises:

determining an oscillatory envelope of data from the autocorrelation calculation; and determining the damping coefficient from a fit of the oscillatory envelope.

3. The method of claim 2, wherein the oscillatory envelope is calculated from a Hilbert Transform of the autocorrelation calculation data.

4. The method of claim 2, wherein the fit comprises a least squares fit.

5. The method of claim 1, wherein the stability margin is estimated from a time rate of change of the damping coefficient.

6. The method of claim 5, wherein an increase of the damping coefficient over time signifies the combustors approach to stable conditions.

7. The method of claim 5, wherein a decrease of the damping coefficient over time signifies the combustors approach to unstable conditions.

8. The method of claim 7, wherein a combustor controller controls combustor parameters to prevent instability in response to the decrease of the damping coefficient over time.

9. The method of claim 8, wherein combustor parameters are selected from the group consisting of engine fuel splits and power output.

10. The method of claim 1, wherein the measuring device measures a combustor quantity selected from the group consisting of chemiluminescence, temperature, species concentration, ion current, rotor vibration, combustor can vibration, and casing vibration.

11. The method of claim 1, wherein the measuring device measures combustor pressure.

12. A system for detection of stability margin in a combustor, comprising:

a measuring device in communication with the combustor, wherein the measuring device generates signals indicative of a combustor quantity; and a stability margin detection unit that receives the signals and performs an autocorrelation technique on the pressure signals to determine the proximity of the combustor to instability.

13. The method of claim 12, wherein the measuring device measures a combustor quantity selected from the group consisting of chemiluminescence, temperature, ion current, rotor vibration, combustor can vibration, and casing vibration.

14. The method of claim 12, wherein the measuring device measures pressure in the combustor.

15. The system of claim 12, further comprising a combustor controller for controlling combustor parameters in response to the results of the autocorrelation technique.

16. The system of claim 12, wherein the autocorrelation technique of the stability margin detection unit includes software code that executes the steps of:

calculating the autocorrelation data of the signal;

determining an oscillatory envelope of the autocorrelation data;

determining a damping coefficient from the oscillatory envelope of the autocorrelation data; and determining the stability margin based on the value of the damping coefficient.

17. The system of claim 16, wherein the autocorrelation technique is implemented in real-time.

18. The system of claim 16, wherein the stability margin decreases when the damping coefficient decreases over time.

19. The system of claim 16, wherein the stability margin increases when the damping coefficient increases over time.

20. A method for detecting the stability margin in a combustor, comprising:

providing a measuring device in communication with the combustor, wherein the measuring device generates signals indicative of a combustor quantity in the combustor;

performing an autocorrelation calculation on the signals to determine the correlation of the signals;

calculating an oscillatory envelope of data from the autocorrelation calculation;

determining a damping coefficient from a fit of the oscillatory envelope;

determining the combustor's proximity to instability based on the damping coefficient; and controlling the stability of the combustor based on the determination of the combustor's proximity to instability.

21. The method of claim 20, wherein the oscillatory envelope is calculated from a Hilbert Transform of the data from the autocorrelation calculation.

22. The method of claim 20, wherein the fit comprises a least squares fit.

* * * * *